US009968197B2

(12) United States Patent
Wong

(10) Patent No.: US 9,968,197 B2
(45) Date of Patent: May 15, 2018

(54) TRAVEL PILLOW

(71) Applicant: Cabeau, Inc., Woodland Hills, CA (US)

(72) Inventor: Jon Wong, Long Beach, CA (US)

(73) Assignee: CABEAU, INC., Woodland Hills, CA (US)

( * ) Notice: Subject to any disclaimer, the term of this patent is extended or adjusted under 35 U.S.C. 154(b) by 112 days.

(21) Appl. No.: 14/518,719

(22) Filed: Oct. 20, 2014

(65) Prior Publication Data

US 2015/0257555 A1 Sep. 17, 2015

Related U.S. Application Data

(60) Provisional application No. 61/951,421, filed on Mar. 11, 2014.

(51) Int. Cl.
*A47G 9/00* (2006.01)
*A47G 9/10* (2006.01)
*A47C 7/38* (2006.01)

(52) U.S. Cl.
CPC ..... *A47C 7/383* (2013.01); *A47C 7/38* (2013.01); *A47G 9/10* (2013.01)

(58) Field of Classification Search
CPC ..... A47G 9/00; A47G 2009/004; A47G 9/10; A47G 9/1072; A47G 9/1081; A47G 2009/1018; A47G 9/1036; A47C 7/383; A47C 21/04; A47C 21/046; A47C 7/36; A47C 7/38; A61F 5/055; Y10T 24/3948; F16G 11/101; A61G 2007/05784
See application file for complete search history.

(56) References Cited

U.S. PATENT DOCUMENTS 15,581 A 8/1856 Slaughter ..... 297/393
D98,859 S 1/1870 Fast
(Continued)

FOREIGN PATENT DOCUMENTS

AU 199176466 11/1991
AU A 7646691 11/1991
(Continued)

OTHER PUBLICATIONS

Third Party Submittal, Kirby IP Canada. dated Sep. 18, 2015.
(Continued)

*Primary Examiner* — David E Sosnowski
*Assistant Examiner* — Rahib T Zaman
(74) *Attorney, Agent, or Firm* — DLA Piper LLP (US)

(57) ABSTRACT

A travel pillow includes a resilient inner frame having a rear portion and two side portions, and a U-shaped outer cushion fixed about the inner frame and including a rear portion and two side portions. Each side portion, and optionally the rear portion, includes at least one transverse air aperture therethrough. Each side portion of the inner frame further includes a forward end. The side portions may each include a drawstring aperture at the forward end for receiving a drawstring having two halves, each of which being mutually and selectively fixable at one part of a two-part mechanical fastener. A flexible cover that has an opening therethrough into which the inner frame and the outer cushion are inserted may be included that has at least one ventilation area through which air may travel.

53 Claims, 6 Drawing Sheets

(56) References Cited

U.S. PATENT DOCUMENTS 1,468,072 A 9/1923 Ogle ..... 5/654
1,787,832 A 5/1929 Mueller
D169,631 S 5/1953 Norman et al.
2,774,601 A 12/1956 White
3,164,151 A 1/1965 Esmond
3,327,330 A 6/1967 McCullough
4,031,578 A 6/1977 Sweeney et al.
D256,728 S 9/1980 Allen
4,285,081 A 8/1981 Price ..... 5/637
D263,625 S 3/1982 McKnight
4,345,347 A 8/1982 Kantor ..... 5/644
4,617,691 A * 10/1986 Monti ..... A47C 7/383 128/DIG. 23
4,847,933 A * 7/1989 Bedford ..... A61G 5/1043 5/652.2
5,205,611 A 4/1993 Stephens
5,313,678 A * 5/1994 Redewill ..... A47C 21/003 297/393
5,339,472 A * 8/1994 Yin ..... A47D 15/006 5/636
5,378,042 A 1/1995 Daneshvar
D368,527 S 4/1996 Brooke
5,588,445 A 12/1996 Brown
D396,594 S 8/1998 Lefebvre
D396,980 S 8/1998 Novros
D404,238 S 1/1999 Keilhauer
D414,974 S 10/1999 Marrone et al.
D416,745 S 11/1999 Noyes
5,974,607 A 11/1999 Smith ..... 5/636
D419,024 S 1/2000 Lenahan
6,010,192 A 1/2000 King ..... 297/397
D420,845 S 2/2000 Rumage
6,219,865 B1 4/2001 Stokesbary
6,230,348 B1 5/2001 Patrikakis ..... 5/636
6,230,349 B1 5/2001 Silver et al. ..... 5/636
D443,461 S 6/2001 Hall
D444,981 S 7/2001 Hall
D445,624 S 7/2001 Futagami ..... D6/604
D446,863 S 8/2001 Carroll
6,408,468 B1 6/2002 Comfort ..... 5/636
6,435,617 B1 8/2002 McNair ..... 297/397
6,447,468 B1 9/2002 Hankins et al. ..... 602/18
D481,247 S 10/2003 Roberts et al. ..... D6/604
6,658,681 B2 * 12/2003 Britto ..... A47D 13/083 5/636
D486,028 S 2/2004 Cathey
D503,062 S 3/2005 Nash
6,926,686 B2 8/2005 Cheatham
6,966,088 B1 * 11/2005 Hu ..... A61G 7/05784 5/630
D522,300 S 6/2006 Roberts
7,185,378 B2 3/2007 Smith ..... 5/642
7,225,485 B2 6/2007 Binder ..... 5/644
D550,495 S 9/2007 Boutin
D567,562 S 4/2008 Nash
7,437,788 B1 10/2008 Holman ..... 5/636
D582,045 S 12/2008 James
D582,713 S 12/2008 Baldwin ..... D6/601
D597,364 S 8/2009 Lindgren
D607,682 S 1/2010 Presman
D619,402 S 7/2010 Sternlight
7,779,492 B2 8/2010 Mangano ..... 5/482
7,788,752 B2 9/2010 Tidwell et al. ..... 5/655
7,865,987 B2 1/2011 Deetsch ..... 5/640
7,909,406 B2 3/2011 Samuelsen ..... 297/397
D637,439 S 5/2011 Mettler
D637,440 S 5/2011 Mettler
D647,624 S 10/2011 Thorgilsdottir
8,144,913 B1 3/2012 Myles ..... 381/374
8,239,987 B2 8/2012 Sharp ..... 5/639
8,316,488 B2 11/2012 Rojas
8,646,134 B1 2/2014 Alletto, Jr.
8,887,332 B2 11/2014 Alletto
8,898,840 B1 * 12/2014 Majette ..... A47C 7/383 297/393
9,015,883 B2 4/2015 Alletto
9,155,408 B2 10/2015 Alletto, Jr.
D746,080 S 12/2015 Mittelstadt ..... D6/601
D754,454 S 4/2016 Schwingendorf ..... D6/601
9,386,868 B2 7/2016 Alletto, Jr.
D762,400 S 8/2016 Wong ..... D6/601
D769,029 S 10/2016 Okwumabua ..... D6/601
2001/0054837 A1 12/2001 O'Connor
2002/0050007 A1 * 5/2002 Kim ..... A47G 9/10 5/636
2002/0129449 A1 * 9/2002 Harker ..... A61G 7/05707 5/726
2003/0135927 A1 * 7/2003 Hsia ..... A47G 9/1009 5/640
2003/0137178 A1 7/2003 Craft et al. ..... 297/452.41
2004/0237206 A1 * 12/2004 Webster ..... A47C 21/046 5/727
2005/0150050 A1 7/2005 Wolf et al. ..... 5/636
2005/0173300 A1 8/2005 O' Connor
2005/0179300 A1 8/2005 O'Connor et al. ..... 297/391
2005/0229557 A1 * 10/2005 Little ..... A47C 7/383 55/385.1
2007/0033737 A1 2/2007 Melton ..... 5/640
2007/0056107 A1 3/2007 Gabriel
2007/0067915 A1 3/2007 Pryor ..... 5/636
2007/0271703 A1 11/2007 Brown et al. ..... 5/636
2007/0297633 A1 12/2007 Kaulfuss
2008/0104764 A1 5/2008 Chen ..... 5/644
2008/0216244 A1 9/2008 Minton
2008/0229498 A1 9/2008 Grosso ..... 5/244
2009/0013471 A1 * 1/2009 Yang ..... A47C 7/383 5/640
2009/0019641 A1 * 1/2009 Ali ..... B60N 2/4882 5/636
2009/0133193 A1 5/2009 Weise ..... 5/640
2009/0276960 A1 11/2009 Chou
2011/0061167 A1 * 3/2011 Farley ..... A47G 9/10 5/652
2011/0094033 A1 * 4/2011 Lee ..... A61F 5/56 5/636
2011/0235832 A1 9/2011 Riopel ..... 381/300
2011/0314609 A1 12/2011 Lee ..... 5/655.3
2012/0011655 A1 * 1/2012 Rojas ..... A47C 7/383 5/636
2012/0313417 A1 * 12/2012 Hurwitz ..... B60N 2/4879 297/391
2013/0098364 A1 * 4/2013 Davis ..... A47G 9/1081 128/206.21
2013/0125312 A1 5/2013 Harooni ..... 5/639
2013/0232693 A1 9/2013 Myers ..... 5/636
2013/0232694 A1 * 9/2013 Ross ..... A47G 9/1009 5/639
2013/0254998 A1 * 10/2013 Walker ..... A47G 9/1081 5/637
2014/0000036 A1 1/2014 Cohen
2014/0021751 A1 * 1/2014 Lang ..... A47D 15/00 297/184.13
2014/0041091 A1 * 2/2014 Sternlight ..... A61F 9/04 2/12
2014/0310877 A1 * 10/2014 Sternlight ..... A47G 9/10 5/639
2015/0150391 A1 * 6/2015 Hsu ..... A47G 9/10 5/636
2015/0257555 A1 * 9/2015 Wong ..... A47C 7/383 5/636
2016/0183685 A1 6/2016 Kang ..... 5/639
2017/0000273 A1 1/2017 Mitchell

FOREIGN PATENT DOCUMENTS

AU 2003201842 10/2003
AU 2003201842 A1 10/2003
CM 301109905 1/2010
CN 86300949 5/1987
CN 3006418 9/1990

(56) References Cited

FOREIGN PATENT DOCUMENTS

| | | | |
|---|---|---|---|
| CN | 3010592 | | 9/1991 |
| CN | 3015753 | | 10/1992 |
| CN | 3052608 | | 12/1996 |
| CN | 013590715 | | 12/2001 |
| CN | 3238498 | | 5/2002 |
| CN | 3289601 | | 4/2003 |
| CN | 3435056 | | 3/2005 |
| CN | 3440171 | | 4/2005 |
| CN | 3476279 | | 9/2005 |
| CN | 2836650 | | 11/2005 |
| CN | 3487002 | | 11/2005 |
| CN | 3497652 | | 1/2006 |
| CN | 2006301323942 | | 6/2006 |
| CN | 3563694 | | 9/2006 |
| CN | 3578942 | | 11/2006 |
| CN | 3614520 | | 2/2007 |
| CN | 300685967 | | 9/2007 |
| CN | 300690834 | | 9/2007 |
| CN | 300707538 | | 11/2007 |
| CN | 300711427 | | 11/2007 |
| CN | 300774484 | | 5/2008 |
| CN | 300811885 | | 8/2008 |
| CN | 300882439 | | 2/2009 |
| CN | 300892694 | | 3/2009 |
| CN | 300941334 | | 6/2009 |
| CN | 300959418 | | 7/2009 |
| CN | 301025929 | | 9/2009 |
| CN | 301137730 | | 2/2010 |
| CN | 301151430 | | 3/2010 |
| CN | 102166088 | | 8/2011 |
| CN | 201958085 | | 8/2011 |
| CN | 202014937 | | 10/2011 |
| CN | 202014937 | U | 10/2011 |
| CN | 103126791 | A | 6/2013 |
| CN | 103458742 | | 12/2013 |
| FR | 1076118 | | 10/1954 |
| GB | 2055656 | | 8/1996 |
| JP | 200015308 | | 10/2001 |
| JP | 3132278 | | 5/2007 |
| JP | 1543718 | | 2/2015 |
| KR | 3019990015333 | | 2/2000 |
| KR | 3020000029799 | | 5/2001 |
| KR | 3020010000482 | | 8/2001 |
| KR | 3020010007585 | | 8/2001 |
| KR | 20050019575 | | 3/2005 |
| KR | 20050019575 | A | 3/2005 |
| KR | 200424871 | | 8/2006 |
| KR | 3020070002191 | | 1/2007 |
| KR | 2020080018019 | | 5/2008 |
| KR | 3020080039948 | | 10/2008 |
| KR | 3020080049371 | | 11/2008 |
| KR | 3008249610000 | | 11/2015 |
| RU | 34338 | U1 | 12/2003 |
| WO | WO 2011122769 | | 10/2011 |
| WO | 2013155003 | A1 | 10/2013 |

OTHER PUBLICATIONS

Third Party Observation from International Appl. No. PCT/US2013/035646, dated Jun. 16, 2014.
Third Party Observation from Australian Appl. No. AU2014100424, dated Jun. 18, 2014.
Patent Examination Report No. 2, from Australian Patent Appl. No. 2013206536, dated Jan. 16, 2015.
Supplementary European Search Report from Appl. No. EP13745557, dated Sep. 15, 2014.
Third Party Observation for Appl. No. EP20130745557. dated Jun. 14, 2014.
Office Action from U.S. Appl. No. 13/488,443, dated Apr. 18, 2014.
Office Action from U.S. Appl. No. 13/488,443, dated Jul. 23, 2015.
Office Action from U.S. Appl. No. 13/488,443. dated Oct. 29, 2014.
Response to Office Action from U.S. Appl. No. 13/488,433, dated Apr. 28, 2015.
Response to Office Action from U.S. Appl. No. 13/488.433, dated Sep. 18, 2014.
Response to Office Action from U.S. Appl. No. 13/488,433, dated Dec. 12, 2014.
Office Action from U.S. Appl. No. 14/394,259, dated May 7, 2015.
Response to Office Action from U.S. Appl. No. 14/394,259, dated Nov. 9, 2015.
Examination from European Patent Appl. No. 13 745 557.2, dated Jun. 12, 2015.
Notice of Preliminary Rejection from Korean Patent Appl. No. 10-2013-7034274, dated Jul. 2, 2015.
International Search Report and Written Opinion from corresponding PCT application No. PCT/US2015/020038, dated May 29, 2015.
Examination from European Patent Appl. No 13 745 557.2-1653, dated Mar. 7, 2016.
Third Party Observations filed with the Australian IP against Australian Patent Appl. No. 2015202263 and received Feb. 23, 2016.
Office Action from U.S. Appl. No. 13/488,443, dated Feb. 11, 2016.
Office Action from U.S. Appl. No. 13/488,443, dated Oct. 29, 2014.
Office Action from U.S. Appl. No. 14/394,259, dated Feb. 5, 2016.
Third party observations on Great Britain Appl. No. GB1418089.7 dated Jun. 23, 2016.
Third Party Observations from corresponding UK Patent appl. No. 1418089.7 dated Oct. 27, 2015.
Notice of Final Rejection from Korean Patent Appl. No. 10-2013-7034274, dated Apr. 15, 2016.
First Office Action (summary) from Mexican Design Appl. No. MX/f/2015/001297, dated Mar. 14, 2016.
Notice of Allowance and Search Report from Taiwanese Patent Appl. No. 10430212, dated Apr. 20, 2016.
Office Action from Columbian Patent Appl. No. 14-249922-4, dated Jun. 16, 2016.
Intention to Grant from European Patent Appl. No. 13 745 557.2-1653, dated Dec. 22, 2016.
Office Action from U.S. Appl. No. 15/348,742, dated Jan. 9, 2017.
Edge, (n. d. ) American Heritage® Dictionary of the English Language, Fifth Edition. (2011), Retrieved Jan. 3, 2017 from http://www.thefreedictionary.com/edge.
Office Action from U.S. Appl. No. 29/568,003, dated Jan. 26, 2017.
3rd party observations filed against European Patent Application No. 13745557.2. filed on Oct. 26, 2016.
Office Action from Chinse Patent Appl. No 201580023142.2. dated Jun. 2, 2017.
Examination Report from corresponding patent appl. No. GB1418089.7, dated Feb. 22, 2017.
Search Report from Russian Federation patent application No. 2013131760, dated Mar. 6, 2017.
International Search Report for International Application No. PCT/US16/54178; dated Sep. 28, 2016.
Office Action for European Patent Application No. 15761243.3, dated Oct. 18, 2017.

* cited by examiner

TRAVEL PILLOW

CROSS-REFERENCE TO RELATED APPLICATIONS

This application claims the benefit of U.S. Provisional Patent Application 61/951,421, filed on Mar. 11, 2014, and incorporated herein by reference.

STATEMENT REGARDING FEDERALLY SPONSORED RESEARCH AND DEVELOPMENT

Not Applicable.

FIELD OF THE INVENTION

This invention relates to pillows, and more particularly to a travel pillow.

DISCUSSION OF RELATED ART

Travel pillows are well known for helping people rest or sleep when in a seated position. However, prior art travel pillows suffer from common drawbacks such being bulky, trapping heat and moisture between the pillow and the user's neck and head, and generally being unable to adequately or comfortably support the person's head.

U.S. Pat. No. 6,926,686 to Cheatham on Aug. 9, 2005, discloses a travel pillow with some of these drawbacks. Little air is allowed to circulate between the pillow and the person's neck with this type of product, often resulting in an uncomfortably hot and sweaty neck. Further, this type of travel pillow causes the user's head to tilt forward due to a relatively large back portion that, when contacting the seat, puts pressure on the rear of the person's neck. U.S. Design Pat. No. D619,402 to Sternlight et al. on Jul. 13, 2010 teaches a similar device. PCT Application PCT/US2013/035646, published on Oct. 17, 2013 to Sternlight et al., teaches a similar device, albeit with a thinner back portion. However, low air circulation is also a drawback of this device.

Therefore, there is a need for a travel pillow that promotes air flow between the pillow and the person's neck for reducing sweat and increasing comfort. Such a needed device would comfortably maintain the user's head in an upright, neutral position during use, and would support the user's head even if tilted to one side or back. Reducing points of contact between such a needed travel pillow and the person's neck and head, while improving air circulation, further would improve comfort and allow for a wider range of accommodated neck sizes. Such a needed invention would be contoured and internally supported to better retain the user's head in a comfortable position while seated. Such a needed device would further be relatively inexpensive to manufacture, easy to use and aesthetically pleasing. The present invention accomplishes these objectives.

SUMMARY OF THE INVENTION

The present device is a travel pillow for a person. A preferably U-shaped resilient inner frame includes a rear portion and two side portions. Each side portion, and optionally the rear portion, includes at least one lateral, transverse air apertures therethrough. Each side portion of the inner frame further includes a forward end.

A U-shaped outer cushion is fixed about the inner frame and includes a rear portion and two side portions. Each side portion, and optionally the rear portion, includes at least one lateral, transverse air apertures therethrough that are each aligned with one of the air apertures of the inner frame. Each side portion of the outer cushion further includes a forward end.

In one embodiment, an upper front portion of the side portions extends upward for contacting the person's jaw and cheek areas to support the person's head in a neutral position. The upper front portion of each side portion is padded such that the cushion compresses at least slightly for continuous support of the person's head when the person's head is in the neutral position, upright and balanced from side-to-side.

The air apertures provide for an abundance of air flow through to the person's neck. The relative size of each of the apertures may vary in size to allow different compression characteristics along the top of the travel pillow. Pillars defined between each aperture are provided to control flexion of the top portion of the outer cushion and inner frame, improve support of the person's head, and provide for a wide range of sizes.

For example, apertures, at the rear portions, may be relatively large so that the top side of the cushion at the rear portion may flex more than, for example, along areas of the side portion. Alternately, larger apertures towards the front of the side portions allow for greater air flow and flexing at the front area of the travel pillow, while smaller apertures and more rigid pillars in the back portion provide for greater support at the back of the person's head.

The travel pillow preferably further includes a closure mechanism fixed with the side portions of the inner frame and outer cushion. Preferably the side portions each include a drawstring aperture at a forward end, thereof. The closure mechanism may include, for example, a drawstring traversing the drawstring apertures of each side portion. Such a drawstring is adapted to selectively and adjustably hold the forward ends mutually together. Alternately, the closure mechanism may be the drawstring traversing at least one of the air apertures, instead of the drawstring apertures.

The drawstring preferably includes two halves, each of which is fixed at a proximal end thereof to the side portions at one of the drawstring apertures thereof. Each drawstring half is mutually and selectively fixable at a distal end thereof at one part of a two-part mechanical fastener. Such a two-part mechanical fastener preferably includes at least one magnet for holding each part together. Each part of the two-part mechanical fastener further preferably includes a spring-biased drawstring cinch mechanism for selectively fixing the part to one of the drawstring halves at a selected position along the length of the drawstring half.

In one embodiment of the invention, each side portion of the outer cushion includes an ear depression formed in a top side thereof. Such an ear depression is adapted to reduce the chance of contact between the top side of the outer cushion with the person's ears, earphones, ear buds, or the like.

The inner frame is preferably C-shaped in cross section at least along part of the side portions. As such, the top portion of the inner frame may flex under the weight of the person's head as the lower part of the inner frame resists flexing. Each side portion of the outer cushion may further include a jawbone depression formed in the top side thereof, such that the travel pillow generally fits under and around a person's jaw to support his head.

A flexible, preferably elastic chin sling may be fixed between the forward ends of each side portion of the outer cushion. Such a chin sling is adapted to support the person's chin to keep the person's head in a substantially upright position. The sling may be removable, adjustable in length and elasticity, include cooling and forming materials such as gel or micro beads, and may also function as the closure mechanism.

In one embodiment, the travel pillow further includes a flexible cover that has an opening therethrough into which the inner frame and the outer cushion are inserted. The cover includes at least one ventilation area through which air may travel. Preferably the cover includes a flexible 4-way stretch fabric.

The present invention is a travel pillow that has a dynamic compression frame and cushioning that has superior support architecture. The present device allows proper flexion for load distributions and dissipations, adjusts to the person's particular anatomy, promotes air flow between the pillow and the person's neck for reducing sweat and increasing comfort. The present device comfortably maintains the user's head in an upright, neutral position during use, and supports the user's head even if tilted to one side or back. The present invention is contoured and internally supported to better retain the user's head in a comfortable position while seated. The present device is further relatively inexpensive to manufacture, easy to use and aesthetically pleasing. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-3B illustrate a travel pillow 10 for a person 20. The travel pillow 10 is well suited for use while the person 20 is sitting, such as while traveling by plane, train, automobile, or the like.

Figure 2A:
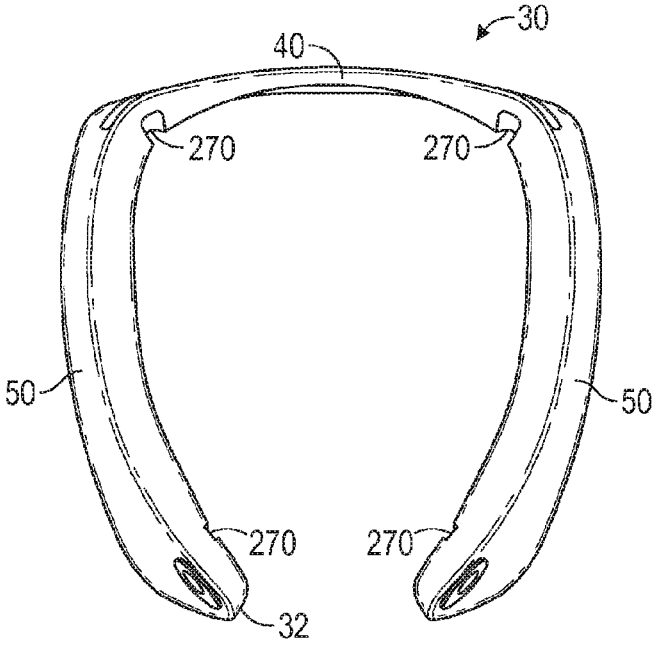
FIG. 2A is a top plan view of an inner frame of the invention.
Figure 2B:
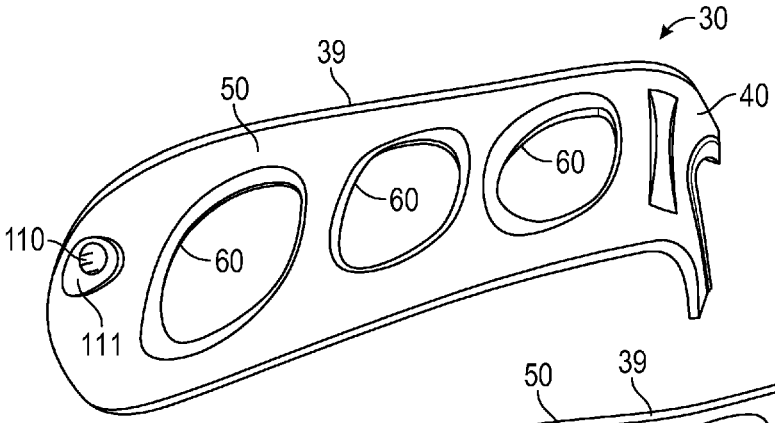
FIG. 2B is a right-side elevational view thereof.
Figure 2C:
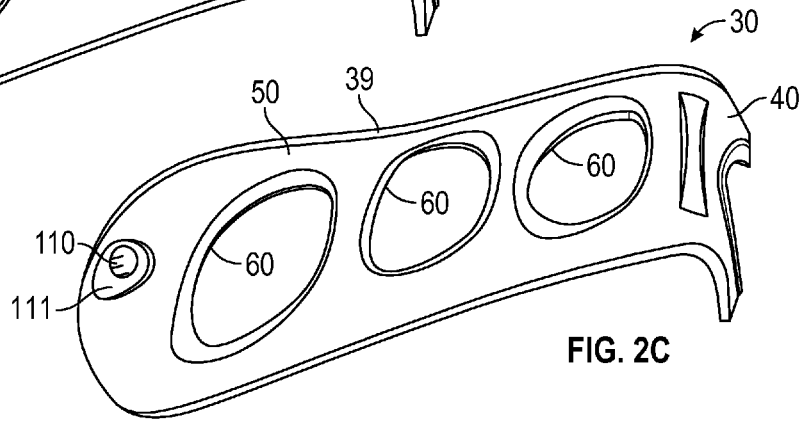
FIG. 2C is an alternate right-side elevational view thereof.

A resilient inner frame 30 includes a rear portion 40 and two side portions 50. The inner frame 30 is preferably U-shaped (FIG. 2A). Each side portion 50, and optionally the rear portion 40, includes at least one lateral, transverse air apertures 60 therethrough (FIG. 2B). Each side portion 50 of the inner frame 30 further includes a forward end 32. A top portion 39 of the inner frame 30 is preferably linear (FIG. 2B), or concave (FIG. 2C) to allow for a comfortable interface between the person's jaw and cheek areas 22 and the travel pillow 10. The top portion 39 of the side portions 50 of the inner frame 30 may also be concave in shape in a front elevational view (FIG. 6), further providing for cupping of the person's jaw and cheek areas 22. The inner frame 30 is made with a resilient plastic or foam material. While the inner frame 30 is preferably U-shaped, as illustrated in FIG. 2A, other embodiments may include a two-part inner frame comprising of the two side portions 50 without the rear portion 40, or three discrete pieces comprising the two side portions 50 and the rear portion 40 that are not in mutual contact, or the like.

A U-shaped outer cushion 70 is fixed about the inner frame 30 and includes a rear portion 80 and two side portions 90. Each side portion 90, and optionally the rear portion 80, includes at least one lateral, transverse air apertures 100 therethrough that are each aligned with one of the air apertures 60 of the inner frame 30. Each side portion 90 of the outer cushion 70 further includes a forward end 72. The outer cushion 70 is made with a pliable or malleable material, such as so-called memory foam, soft rubber, or the like.

In one embodiment, an upper front portion 59 (FIG. 3B) of the side portions 90 extends upward for contacting the person's jaw and cheek areas 22 to support the person's head 25 in a neutral position. The upper front portion 59 of each side portion 90 is padded such that the cushion 70 compresses at least slightly for continuous support of the person's head 25 when the person's head 25 is in the neutral position, upright and balanced from side-to-side.

Figure 5:
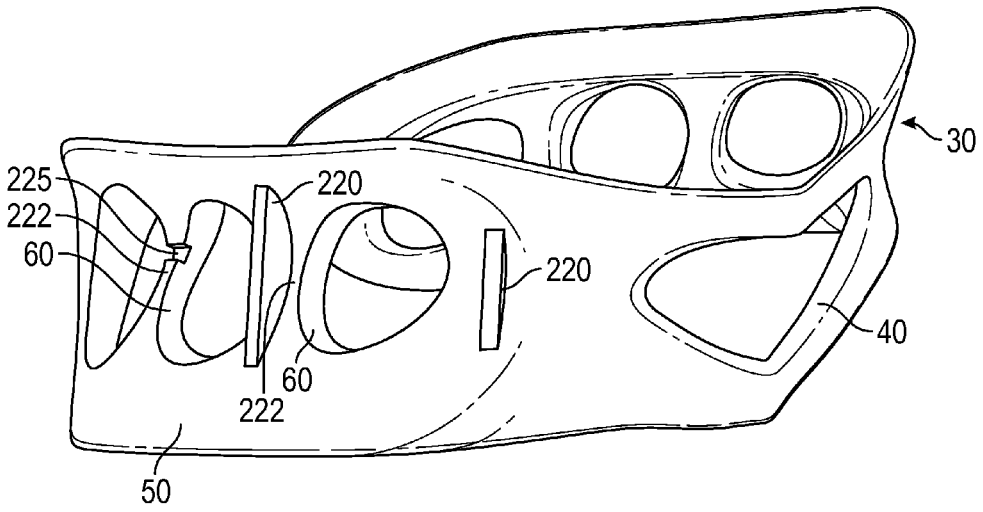
FIG. 5 is a rear perspective view of one embodiment of the inner frame.
Figure 8A:
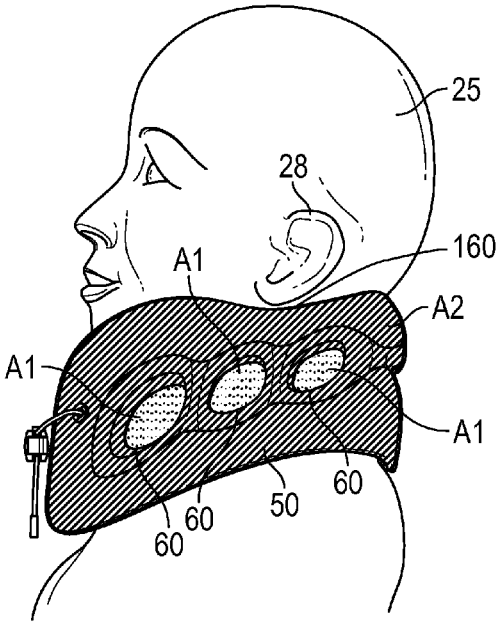
FIG. 8A is a side elevational view of the invention, showing an air aperture area as compared to a non-aperture area.
Figure 8B:
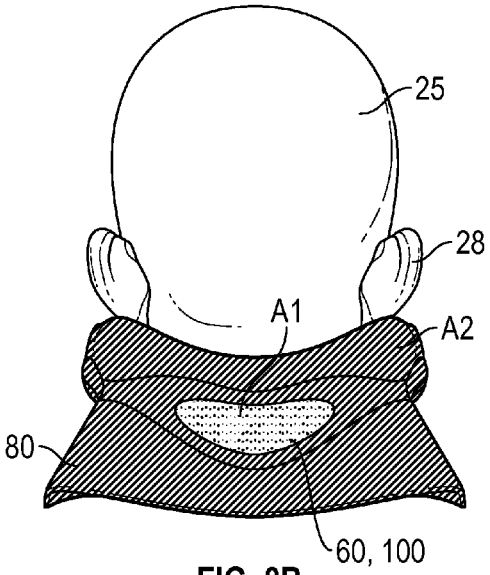
FIG. 8B is a rear elevational view of the invention, showing an air aperture area as compared to a non-aperture area.

The air apertures 60,100 preferably cover a surface area A1 of between 5% and 85% compared to the non-aperture area A2 (FIGS. 8A and 8B), providing for flexion under load compression, and an abundance of air flow through to the person's neck 26. As such, the air apertures 60,100 in the inner frame 30 and the outer cushion 70 allow the top side 71 to flex under the weight of the person's head 25. The relative size of each of the apertures 60,100 may vary in size to allow different compression characteristics along the length of the travel pillow 10. For example, apertures 60,100 at the rear portions 40,80 may be relatively small for better structurally support. Moreover, a plurality of reinforcements 220 (FIG. 5) may be fixed with the inner frame 30 between certain of the air apertures 60 on pillars 222 formed therebetween in order to reduce bending of the inner frame 30 except at a top portion 39 thereof. One or more flex grooves 225 may also be formed in one or more of the resilient pillars 222 to further promote flexing thereof when under pressure at the flex grooves 225.

Each side portion 50 of the inner frame 30 preferably further includes at least one folding groove 270 proximate the rear portion 40 (FIG. 2A). As such, the side portions 90 of the outer cushion 70 and the side portions 50 of the inner frame 30 may each be folded towards the rear portions 40,80 for compact storing of the travel pillow 10. A similar folding groove 270 may be included at corresponding locations on the outer cushion 70 as well (not shown). Another folding groove 270 proximate the front end 32 of the inner frame 30 may be included for providing better fitting around a smaller person 20.

Figure 1:
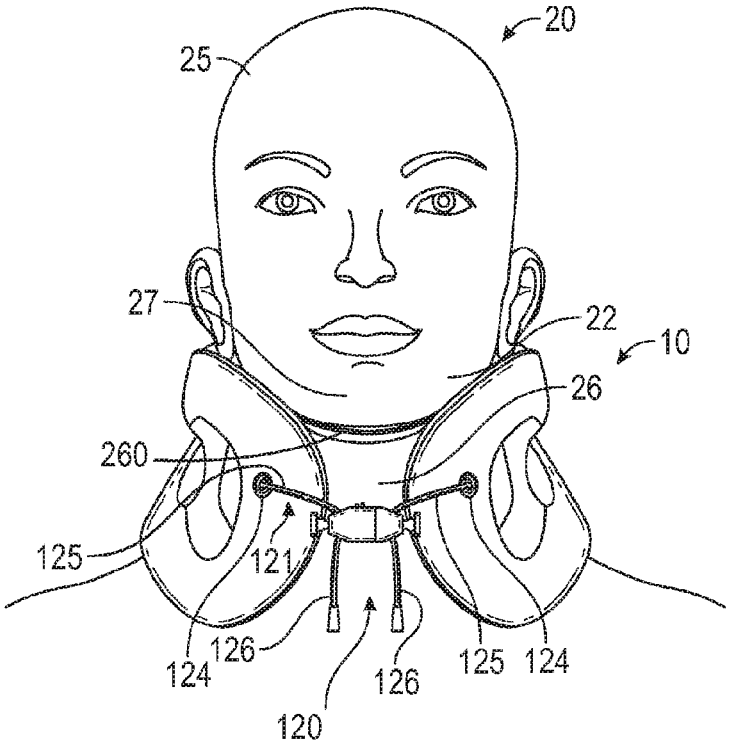
FIG. 1 is a front elevational view of the invention.
Figure 4A:
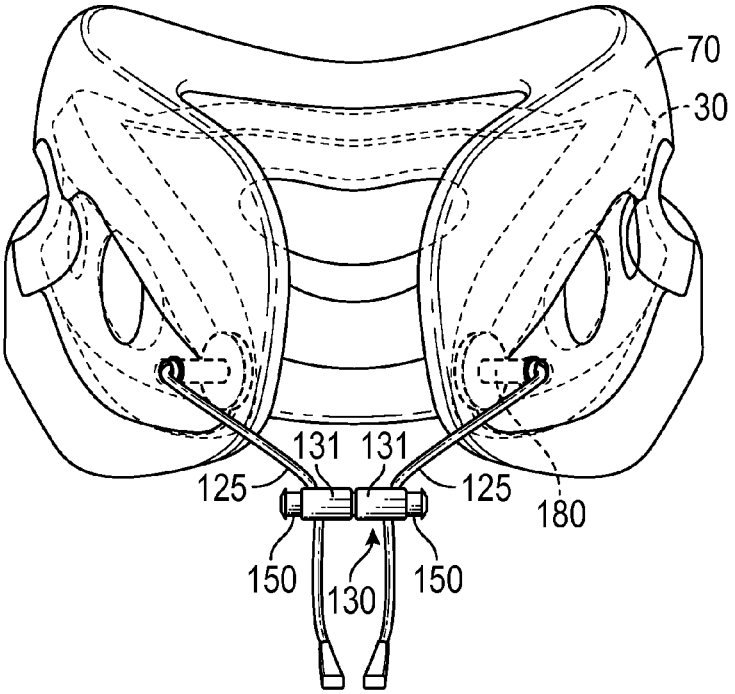
FIG. 4A is a front elevational view of the invention, illustrating in phantom outline the position of the internal frame within an outer cushion of the invention.
Figure 4B:
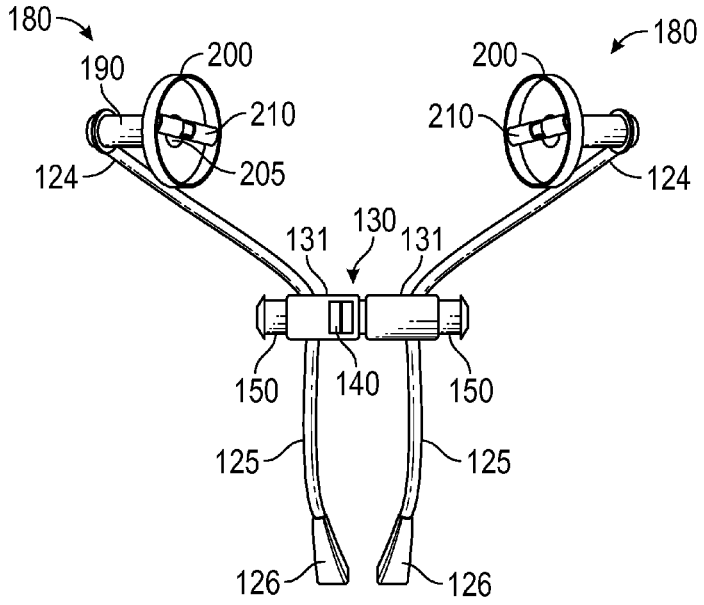
FIG. 4B is a front elevational view of a closure mechanism of the invention, illustrated with the inner frame and the cushion omitted for clarity of illustration.

The travel pillow 10 preferably further includes a closure mechanism, such as the closure mechanism 120 shown in FIG. 1 or the closure mechanism 130 shown in FIGS. 4A & 4B, fixed with the side portions 32,72 of the inner frame 30 and/or the outer cushion 70. Preferably the side portions 50,90 of the inner frame 30 and the outer cushion 70 each include a drawstring aperture 110 at a forward end 32,72 thereof, respectively. The closure mechanism 120 may include, for example, a drawstring 121 traversing the drawstring apertures 110 of each side portion 50,90. Such a drawstring 121 is adapted to selectively and adjustably hold the forward ends 32,72 mutually together. Alternately, the closure mechanism 120 may be the drawstring 121 traversing at least one of the air apertures 60,100 instead of the drawstring apertures 110. Alternately, the closure mechanism 120 may be a length of hook-and-loop type fastening material (not shown) looped through at least one of the air apertures 60,100, or a strap with a mechanical snap fastener (not shown), or the like.

The drawstring 121 preferably includes two halves 125, each of which is fixed at a proximal end 124 thereof to the side portions 50,90 of the inner frame 30 and the outer cushion 70 at one of the drawstring apertures 110 thereof. Each drawstring half 125 is mutually and selectively fixable at a distal end 126 thereof at one part 131 of a two-part mechanical fastener 130 (FIGS. 4A & 4B). Such a two-part mechanical fastener 130 preferably includes at least one magnet 140 for holding each part 131 together. Each part 131 of the two-part mechanical fastener 130 further preferably includes a spring-biased drawstring cinch mechanism 150 for selectively fixing the part 131 to one of the drawstring halves 125 at a selected position along the length of the drawstring half 125.

A pair of drawstring anchors 180 (FIGS. 4A, 4B) may be included, each having a tube 190 fixed with a center portion 205 of a disk 200. The tube 190 is adapted for fitting within one of the drawstring apertures 110, and the disk 200 is large enough to prevent the anchor 180 from traversing the drawstring aperture 110. The proximal end 124 of each drawstring half 125 terminates at a T-shaped anchor 210 which is able to traverse each drawstring apertures 110 when aligned with the end 124 of the drawstring half 125, but when flipped 90-degrees is retained by the disk 200 and prevented from being pulled back through the drawstring aperture 110. As such, the drawstring 121 may not be pulled through the inner frame 30 or outer cushion 70. Both the inner frame 30 and the outer cushion 70 may further include a thicker anchor reinforcement area 111 about the drawstring apertures 110 to further inhibit the drawstring 120 from being pulled through or ripping the outer cushion 70 or the inner frame 30.

In one embodiment of the invention, each side portion 90 of the outer cushion 70 includes an ear depression 160 (FIG. 8A) formed in a top side 71 thereof. Such an ear depression 160 is adapted to reduce the chance of contact between the top side 71 of the outer cushion 70 with the person's ears 28, earphones (not shown), ear buds (not shown), or the like.

Preferably, at least a portion of an inside surface 74 of the outer cushion 70 at the top side 71 thereof or a center portion 75 thereof (FIG. 6) is sloped inwardly with respect to a bottom side 79 thereof, preferably at an angle $\alpha$ of between 2 and 85-degrees. Preferably, along the inside surface 74, the center portion 75 protrudes inwardly along at least one portion of its length with respect to the top and bottom sides 71,79 of the outer cushion. This angle $\alpha$ may vary along the length of the side portions 90 and rear portion 80.

In such an embodiment, the inner frame 30 is preferably C-shaped in cross section (FIG. 6), preferably at least along part of the side portions 50. As such, the top portion 39 of the inner frame 30 may flex under the weight of the person's head 25 as the lower part of the inner frame 30 resists flexing.

Figure 7:
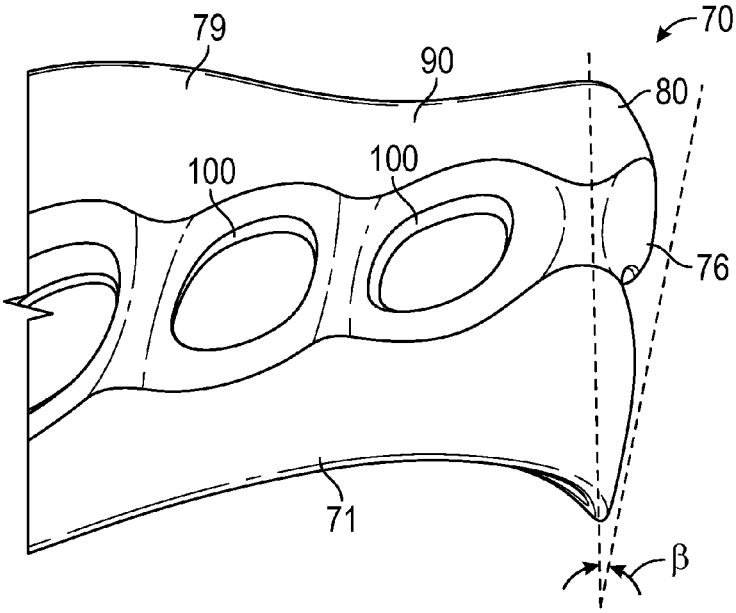
FIG. 7 is a partial side elevational view of another embodiment showing a rear portion of the invention sloped with respect to vertical.

In one embodiment, an outside surface 76 of the outer cushion 70 at the top side 71 thereof is sloped outwardly with respect to the bottom side 79 thereof, preferably at an angle $\beta$ of between 2 and 30-degrees (FIG. 7). As such, contact between the outer cushion 70 and a seat (not shown) urges the travel pillow 10 to tilt forward rather than backward, a forward tilt of the travel pillow 10 being more comfortable to the person 20 and reducing the choking effect caused when such a travel pillow is tilted upward. That notwithstanding, the rear portions 40,80 are thin enough to minimize pressure transmitted from the seat through the rear portions 40,80 to the back of the person's head 25.

Figure 3A:
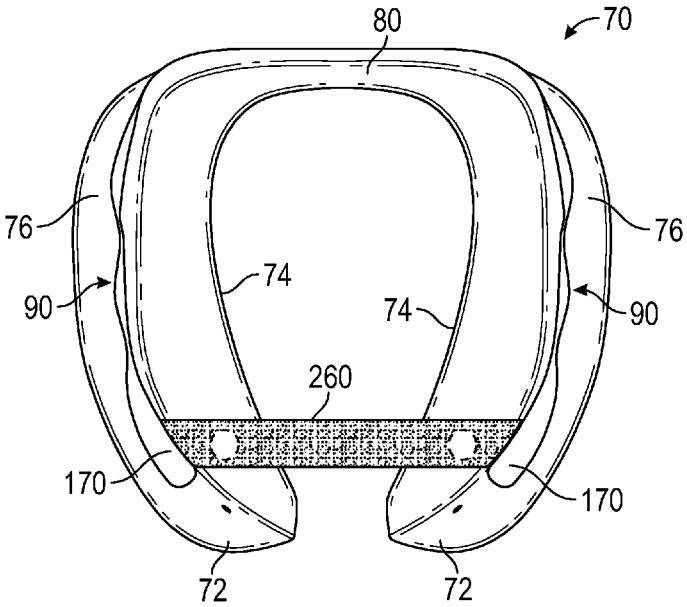
FIG. 3A is a top plan view of the invention.
Figure 6:
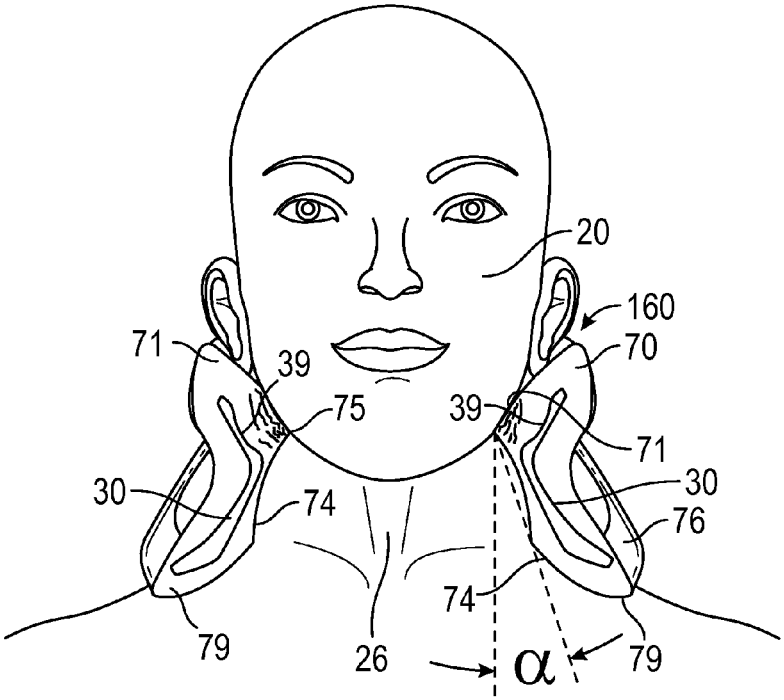
FIG. 6 is a front elevational view of another embodiment, illustrated with the inner frame and outer cushion cut away to show the interface between the invention and a person's jaw.

In one embodiment, each side portion 90 of the outer cushion 70 further includes a jawbone depression 170 formed in the top side 71 thereof, such that the travel pillow 10 generally fits under and around a person's jaw 22 to support his head 25 (FIGS. 3A and 6). Preferably when the person's head 25 is in a neutral vertical position, the top side 71 of the outer cushion 70 is compressed slightly to provide support to the person's head 25 in the neutral position (FIG. 1).

Figure 10A:
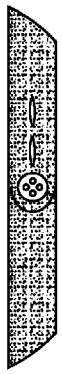
FIG. 10A is a top plan view of one embodiment of a chin sling of the invention.
Figure 10B:
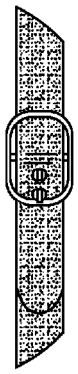
FIG. 10B is a top plan view of an alternate embodiment of the chin sling.
Figure 3B:
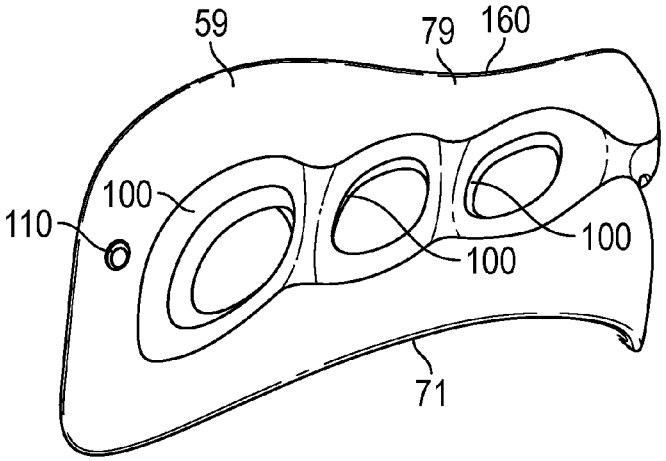
FIG. 3B is a right-side elevational view thereof.

A flexible, preferably elastic chin sling 260 (FIGS. 3A, 10A, & 10B) may be fixed between the forward ends 72 of each side portion 90 of the outer cushion 70. Such a chin sling 260 is adapted to support the person's chin 27 to keep the person's head 25 in a substantially upright position. The sling 260 may be adjustable in location, length and elasticity, and may also function as the closure mechanism 120. Such a chin sling 260 may include the mechanical two-part fastener 130 such as buttons (FIG. 10A), snaps (not shown), a buckle (FIG. 10B), magnets (FIG. 3A), hook and loop-type material (not shown), or the like. Such a chin sling 260 may be selectively removable from one of the side portions 90 or both of the side portions 90.

Figure 9:
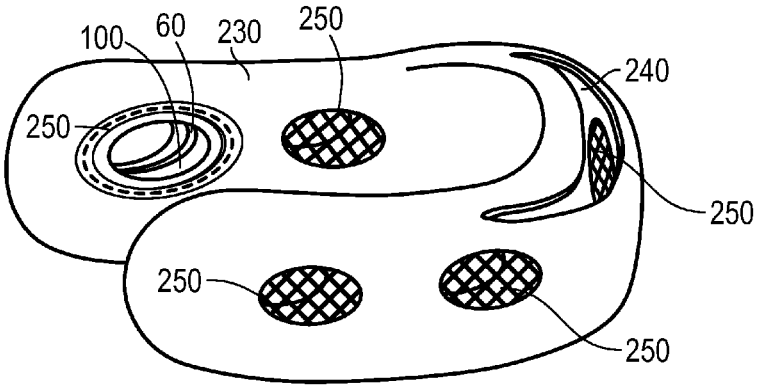
FIG. 9 is a bottom perspective view of a cover of the invention.

In one embodiment, the travel pillow 10 further includes a flexible cover 230 (FIG. 9) that has an opening 240 therethrough into which the inner frame 30 and the outer cushion 70 are inserted. The cover 230 includes at least one ventilation area 250 through which air may travel through the cover 230, the air apertures 60,100 of the inner frame 30 and the outer cushion 70, and through the cover 230 again. Preferably the cover includes a flexible 4-way stretch fabric.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A travel pillow comprising:

a resilient inner frame including a rear portion and two side portions, each side portion of the inner frame comprising a plurality of lateral, transverse air apertures therethrough, wherein each side portion of the inner frame comprises at least one pillar between two of the air apertures of the inner frame; and a pliable U-shaped outer cushion fixed about the inner frame and including a rear portion and two side portions that extend substantially horizontally from the rear portion of the outer cushion, each side portion of the outer cushion comprising a plurality of lateral, transverse air apertures therethrough that are each aligned with one of the air apertures of the inner frame;

wherein an upper front portion of each of the side portions of the outer cushion extends upward, the upper front portions of the outer cushion configured to contact a person's jaw to support a head of the person; and wherein the inner frame is substantially U-shaped and has a vertical cross-section that is substantially outwardly C-shaped along at least part of the side portions of the inner frame so as to allow a top portion of the inner frame to flex under weight of the person's head.

2. The travel pillow of claim 1 further including a closure mechanism fixed at a forward end of each side portion of the inner frame and/or the outer cushion, the closure mechanism adapted to selectively secure the forward ends of the outer cushion side portions mutually together.

3. The travel pillow of claim 2 wherein the side portions of the inner frame and the outer cushion each include a drawstring aperture at the forward end thereof, and wherein the closure mechanism includes a drawstring traversing each drawstring aperture.

4. The travel pillow of claim 2 wherein the closure mechanism is a drawstring traversing at least one of the air apertures, the drawstring adapted to selectively, adjustably hold the forward ends of each outer cushion side portion together.

5. The travel pillow of claim 3 wherein the drawstring includes two halves, each drawstring half fixed to one part of a two-part mechanical fastener.

6. The travel pillow of claim 5 wherein the two-part mechanical fastener includes at least one magnet for holding the two parts together.

7. The travel pillow of claim 6 wherein each part of the two-part mechanical fastener includes a spring-biased drawstring cinch mechanism for selectively fixing the part to its respective drawstring half at a selected position along the length of the drawstring half.

8. The travel pillow of claim 1 wherein each side portion of the outer cushion includes an ear depression formed in a top side thereof.

9. The travel pillow of claim 1 wherein an inside surface of the outer cushion at a center portion thereof is sloped inwardly with respect to both a top side and a bottom side thereof.

10. The travel pillow of claim 1 wherein an inside surface of the outer cushion at a top side thereof is sloped inwardly with respect to a bottom side thereof.

11. The travel pillow of claim 10 wherein the inside surface of the outer cushion at the top side thereof is sloped inwardly with respect to the bottom side thereof at an angle of between 2 and 65-degrees.

12. The travel pillow of claim 1 wherein an outside surface of the rear portion of the outer cushion at a top side thereof is sloped outwardly with respect to a bottom side thereof.

13. The travel pillow of claim 12 wherein the outside surface of the rear portion of the outer cushion at the top side thereof is sloped outwardly with respect to the bottom side thereof at an angle of between 2 and 30-degrees.

14. The travel pillow of claim 1 wherein each side portion of the outer cushion includes a jawbone depression formed in a top side thereof, whereby the travel pillow generally fits under a person's jaw to support his head.

15. The travel pillow of claim 1 wherein the ratio of an air aperture area to a non-aperture area of the travel pillow is between 5% and 85%.

16. The travel pillow of claim 1 wherein the air apertures of the inner frame vary in size and the air apertures of the outer cushion vary in size to allow for different compression characteristics along the travel pillow.

17. The travel pillow of claim 3 further including a pair of drawstring anchors that each includes a tube fixed with a disk, the tube adapted for fitting within one of the drawstring apertures and the disk adapted for preventing the anchor from completely traversing the drawstring aperture.

18. The travel pillow of claim 17 wherein the drawstring includes two drawstring halves, and wherein a proximal end of each drawstring half terminates at one of said drawstring anchors, each drawstring half adapted to traverse the tube of its respective drawstring anchor when aligned with the tube, and wherein each drawstring anchor is adapted to retain the proximal end of its respective drawstring half when the drawstring half is not aligned with the tube.

19. The travel pillow of claim 1 wherein both the inner frame and the outer cushion are foam.

20. The travel pillow of claim 1 wherein the rear portions of the inner frame and outer cushion include at least one air aperture.

21. The travel pillow of claim 1 further including a cover having an opening therethrough into which the inner frame and outer cushion can be inserted, the inner frame and outer cushion being within the cover, the cover including at least one ventilation area through which air may travel through the cover, through the air apertures of the inner frame and outer cushion, and through the cover again.

22. The travel pillow of claim 21 wherein the cover includes a 4-way stretch fabric.

23. The travel pillow of claim 21 wherein the at least one ventilation area includes a material that is more breathable, open, and/or visually less obstructive than other portions of the cover.

24. The travel pillow of claim 1 wherein a top portion of the inner frame is linear or convex.

25. The travel pillow of claim 24 wherein the top portion of the inner frame is sloped inward and convex, whereby the top portion of the inner frame generally follows the anatomy of the person's jawbone and cheek areas.

26. The travel pillow of claim 1 further including a chin sling fixed between front portions of each side portion of the outer cushion, the chin sling adapted to support the person's chin to keep the person's head in a substantially upright position.

27. The travel pillow of claim 26 wherein the chin sling is selectively removable from the outer cushion with at least one two-part mechanical fastener.

28. The travel pillow of claim 27 wherein the two-part mechanical fastener further allows the length of the chin strap to be selectively adjusted.

29. The travel pillow of claim 19 wherein the pillars are foam.

30. A travel pillow, comprising:

a substantially U-shaped outer cushion comprising a cushion left side portion, a cushion right side portion, and a cushion rear portion, said cushion left side portion and said cushion right side portion extending substantially horizontally from said cushion rear portion; and a substantially U-shaped inner frame within said outer cushion, said inner frame comprising a frame left side portion, a frame right side portion, and a frame rear portion, said inner frame being more resilient than said outer cushion;

wherein said travel pillow is shaped to define a first air aperture extending through said cushion left side portion and said frame left side portion, a second air aperture extending through said cushion right side portion and said frame right side portion, and a third air aperture extending through said cushion rear portion and said frame rear portion;

wherein said cushion left side portion comprises a cushion left top surface and wherein said cushion right side portion comprises a cushion right top surface;

wherein each of said cushion left top surface and said cushion right top surface comprises a portion that extends upward and is configured to contact a person's jaw;

wherein a rear surface of said cushion rear portion is shaped to define an indentation; and wherein a portion of said rear surface below said indentation slopes outward from bottom to top before meeting said indentation.

31. The travel pillow of claim 30, wherein said travel pillow is shaped to define a fourth air aperture extending through said cushion left side portion and said frame left side portion, and is further shaped to define a fifth air aperture extending through said cushion right side portion and said frame right side portion.

32. The travel pillow of claim 31, wherein said third air aperture has a size and a shape different than a size and a shape of each of said first, second, fourth, and fifth air apertures.

33. The travel pillow of claim 32, wherein said size of each of said first and second air apertures is different than said size of each of said fourth and fifth air apertures.

34. The travel pillow of claim 30, wherein each of said frame left side portion, said frame right side portion, said frame rear portion, said cushion left side portion, said cushion right said portion, and said cushion rear portion is substantially vertically oriented.

35. The travel pillow of claim 30, wherein each of said frame left side portion and said frame right side portion has a substantially outwardly C-shaped vertical cross section along at least a portion of a length thereof, such that each of a top portion of said frame left side portion and a top portion of said frame right side portion is configured to flex under weight of the person's head.

36. The travel pillow of claim 35, wherein each of said frame left side portion, said frame right side portion, said frame rear portion, said cushion left side portion, said cushion right said portion, and said cushion rear portion is substantially vertically oriented.

37. The travel pillow of claim 36, wherein said portion of said rear surface below said indentation slopes outward from bottom to top at an angle between 2 degrees and 30 degrees before meeting said indentation.

38. The travel pillow of claim 30, wherein said outer cushion is primarily made of a first material that is foam and said inner frame is primarily made of a second material that is plastic or foam.

39. The travel pillow of claim 38, wherein said second material is foam.

40. A travel pillow comprising:

a resilient inner frame including a rear portion and two side portions, each side portion comprising a plurality of lateral, transverse air apertures therethrough;

a pliable U-shaped outer cushion fixed about the inner frame and including a rear portion and two side portions, each side portion comprising a plurality of lateral, transverse air apertures therethrough that are each aligned with one of the air apertures of the inner frame; and a closure mechanism fixed at a forward end of each side portion of the inner frame and the outer cushion, the closure mechanism adapted to selectively secure the forward ends of the outer cushion side portions mutually together;

wherein the side portions of the inner frame and the outer cushion each include a drawstring aperture at the forward end thereof, and wherein the closure mechanism includes a drawstring traversing each drawstring aperture;

wherein the travel pillow further comprises a pair of drawstring anchors that each includes a tube fixed with a disk, each tube at least partially within a respective one of the drawstring apertures and each disk adapted for preventing its respective anchor from completely traversing its respective drawstring aperture.

41. The travel pillow of claim 40 wherein the drawstring includes two drawstring halves, and wherein a proximal end of each drawstring half terminates at a respective one of the drawstring anchors, each drawstring half adapted to traverse the tube of its respective drawstring anchor when aligned with the tube, and wherein each drawstring anchor is adapted to retain the proximal end of its respective drawstring half when the drawstring half is not aligned with the tube.

42. The travel pillow of claim 30, wherein each of said first and second air apertures has a height that is at least half the height of said inner frame.

43. The travel pillow of claim 30, wherein each of said cushion left top surface and said cushion right top surface is shaped to define an ear depression rearward of its respective portion that extends upward.

44. The travel pillow of claim 1 wherein the upper front portion of each of the side portions of the outer cushion extends upward along at least a portion of a length of its respective side portion.

45. The travel pillow of claim 1 wherein the pillars provide structural support to support the head of the person.

46. The travel pillow of claim 30, wherein said third air aperture is through said indentation.

47. A travel pillow comprising: a pliable U-shaped cushion including a rear portion and two side portions that extend substantially horizontally from the rear portion; wherein an upper front portion of each of the side portions extends upward, the upper front portions of the cushion configured to contact a person's jaw to support a head of the person; wherein at least part of an outer surface of each of the side portions has a vertical cross-section that is substantially outwardly C-shaped along at least part of the respective side portion's length, so as to allow a top portion of each of the side portions to flex under weight of the person's head; and wherein an outside surface of the rear portion is shaped to define an indentation, and wherein a portion of the outside surface of the rear portion below the indentation slopes outward from bottom to top before meeting the indentation.

48. The travel pillow of claim 47 wherein an inside surface of the cushion at a center portion thereof is sloped inwardly with respect to both a top side and a bottom side thereof.

49. The travel pillow of claim 47 wherein an inside surface of the cushion at a top side thereof is sloped inwardly with respect to a bottom side thereof.

50. The travel pillow of claim 49 wherein the inside surface of the cushion at the top side thereof is sloped inwardly with respect to the bottom side thereof at an angle of between 2 and 65-degrees.

51. The travel pillow of claim 49 wherein the inside surface of the cushion at the bottom side thereof is sloped inwardly with respect to the top side thereof.

52. The travel pillow of claim 47 wherein at least part of an inside surface of each of the side portions has a vertical cross-section that is substantially outwardly C-shaped along at least part of the respective side portion's length.

53. The travel pillow of claim 47 wherein the portion of the outside surface of the rear portion below the indentation slopes outward from bottom to top at an angle between 2 degrees and 30 degrees before meeting the indentation.

* * * * *